US007563047B2

(12) United States Patent
Paluda

(10) Patent No.: US 7,563,047 B2
(45) Date of Patent: Jul. 21, 2009

(54) TRAVELING CRAYON HOLDER

(76) Inventor: Andrew J. Paluda, 32741 Friar Tuck La., Beverly Hills, MI (US) 48025

( * ) Notice: Subject to any disclaimer, the term of this patent is extended or adjusted under 35 U.S.C. 154(b) by 490 days.

(21) Appl. No.: 11/113,862

(22) Filed: Apr. 25, 2005

(65) Prior Publication Data

US 2006/0239756 A1 Oct. 26, 2006

(51) Int. Cl.
*B43K 23/02* (2006.01)

(52) U.S. Cl. ..... 401/131; 401/52

(58) Field of Classification Search ..... 401/131, 401/52, 195

See application file for complete search history.

(56) References Cited

U.S. PATENT DOCUMENTS

| | | | | | |
|---|---|---|---|---|---|
| 264,593 | A | * | 9/1882 | Wright | 242/385.1 |
| 452,830 | A | * | 5/1891 | Bowie et al. | 224/220 |
| 1,053,626 | A | * | 2/1913 | Miller | 70/457 |
| 1,134,691 | A | * | 4/1915 | Martin et al. | 211/69.6 |
| 1,537,192 | A | * | 5/1925 | Rice | 24/566 |
| 1,603,713 | A | * | 10/1926 | Peterson | 401/93 |
| 1,814,710 | A | * | 7/1931 | Komorous | 24/116 A |
| 1,957,577 | A | * | 5/1934 | Chapman | 150/160 |
| 2,432,957 | A | * | 12/1947 | Webster | 211/113 |
| 2,557,970 | A | * | 6/1951 | Jablon | 206/348 |
| 3,699,704 | A | * | 10/1972 | Hakim | 446/227 |
| 4,361,934 | A | * | 12/1982 | Darnell | 24/3.12 |
| 4,749,195 | A | | 6/1988 | Lee | 273/1 |
| 4,765,583 | A | | 8/1988 | Tenner | 248/444 |
| D306,177 | S | * | 2/1990 | Park | D19/36 |
| D316,734 | S | | 5/1991 | Tak | D21/157 |
| 5,351,346 | A | * | 10/1994 | Hodges, Jr. | 4/605 |
| 5,360,342 | A | * | 11/1994 | Pardner | 434/84 |
| 5,379,928 | A | | 1/1995 | Mikkelsen | 224/257 |
| D362,876 | S | | 10/1995 | Pedersen | D21/108 |
| 5,688,062 | A | * | 11/1997 | Shih | 401/18 |
| 5,722,125 | A | * | 3/1998 | Vasilopoulos | 24/301 |
| 5,934,123 | A | * | 8/1999 | Eldredge | 70/456 R |
| 5,947,623 | A | * | 9/1999 | Smith | 401/131 |
| 5,987,759 | A | * | 11/1999 | Nita | 30/454 |
| 6,000,103 | A | * | 12/1999 | Paice et al. | 24/10 R |
| 6,216,319 | B1 | * | 4/2001 | Elkins | 24/3.2 |
| D455,527 | S | * | 4/2002 | Epstein | D30/153 |
| 6,394,677 | B2 | | 5/2002 | Wang | 401/6 |
| 6,413,141 | B1 | * | 7/2002 | Putney | 446/227 |
| 6,425,167 | B1 | * | 7/2002 | Barbarite et al. | 24/298 |
| 6,427,374 | B1 | * | 8/2002 | Vaiani | 42/85 |
| 6,434,800 | B1 | * | 8/2002 | James et al. | 24/298 |
| 6,435,749 | B1 | * | 8/2002 | Lecce | 401/131 |
| 6,439,945 | B1 | | 8/2002 | Liu | 446/71 |
| 6,450,718 | B1 | * | 9/2002 | Spruill | 401/131 |
| 6,499,899 | B2 | * | 12/2002 | Sawyer | 401/131 |
| D469,122 | S | * | 1/2003 | Rosenbaum | D19/36 |
| 6,530,131 | B1 | * | 3/2003 | Hopkins | 24/300 |
| 6,938,291 | B1 | * | 9/2005 | Cheng | 5/658 |

(Continued)

*Primary Examiner*—David J Walczak
(74) *Attorney, Agent, or Firm*—Gifford, Krass, Spinkle, Anderson & Citkowski, P.C.

(57) ABSTRACT

A traveling crayon holder including a three dimensional plush body. A plurality of arms extend from the body, the arms each further comprising a length of a flexible line material. A plurality of crayons are secured in individual fashion to respective ends of each of the lengths of flexible line material. An engagement portion extends from a further location of the plush body and provides for securing the body to a fixed location.

13 Claims, 5 Drawing Sheets

U.S. PATENT DOCUMENTS 6,942,408 B2 * 9/2005 Smith ..... 401/6
7,036,189 B2 * 5/2006 Steigerwald ..... 24/300
7,124,477 B2 * 10/2006 Boland ..... 24/116 A
2004/0109719 A1 * 6/2004 Rosso ..... 401/131
2005/0220529 A1 * 10/2005 Katsanevas ..... 401/131
2006/0147033 A1 * 7/2006 Chung ..... 379/428.01
2006/0272890 A1 * 12/2006 Harmon et al. ..... 182/3
2007/0048067 A1 * 3/2007 Gerules et al. ..... 401/195

* cited by examiner

TRAVELING CRAYON HOLDER

FIELD OF THE INVENTION

The present invention is directed to a traveling crayon holder, particularly for use by toddlers and children. More specifically, the present device is capable of being used by children traveling in a vehicle and which prevents crayons from being lost or misplaced in the vehicle seats and under the floorboards.

DESCRIPTION OF THE PRIOR ART

The prior art is documented with varying types of suspending cord/leash devices, as well as other examples of prior art designs, and such as generally related to toy octopuses or squids. A first example drawn from the prior art is set forth in U.S. Pat. No. 6,394,677, issued to Wang, and which discloses a hanging pen including a pen cap and a pen holder. The pen cap has a blocking cover with a loop cord for carrying and an opening at the other end.

The penholder provides a center stick therein with a writing head of the center stick extending outwardly from a conical part at an end of the penholder. A magnetic ring is fixed in the pen cap. The conical part is made of magnet inducing material. The pen cap engages the penholder by way of the magnetic ring attracting the conical part when the conical part is inserted into the pen cap from the open end.

A further example is set forth in U.S. Pat. No. 5,379,928, issued to Mikkelsen, and which teaches an adjustable breakaway neck noose for retaining an end of a cylindrical container comprising a flexible cord of a predetermined length having an exterior surface of a woven material and having a first end and a second end which can from a noose therebetween. A holder is incorporated for holding the end of the cylindrical container having a top surface defining a raised tab and a hole transversely defined therethrough of sufficient size to receive the first and second ends of the cord, yet frictionally engage the exterior surface of the cord.

The holder can be positioned along a locus of points along the length of the cord so as to change the size of the noose. A bottom surface of the holder defines a cup with interior cylindrical walls sized to receive and frictionally engage the end of a cylindrical container. A clip is incorporated for clipping the first and second ends of the cord together and frictionally holding the first and second ends of the cord. The clip releases the ends of the cords when a predetermined amount of tension above one pound is exerted between the clip and cord.

Also known in the art are various and decorative toy articles, such as exhibiting an octopus-like shape and these include octopus shaped build-up toy of Liu, U.S. Pat. No. 6,439,945, as well as the fishing octopus toy of Lee, U.S. Pat. No. 4,749,195. Other design patents based upon an eight-legged octopus article include Pedersen, U.S. Design Pat. No. 362,876 and Tak, U.S. Design Pat. No. 316,734.

SUMMARY OF THE PRESENT INVENTION

The present invention discloses a traveling crayon holder, particularly for use by toddlers and children. More specifically, the present device is capable of being used by children traveling in a vehicle and which prevents crayons from being lost or misplaced in the vehicle seats and under the floorboards.

The device includes a three dimensional plush body from which extend a plurality of arms. Each of the arms each further includes a length of a flexible line material. A plurality of crayons are each secured in individual fashion to respective ends of each of the lengths of flexible line material. In a preferred application, a plurality of hollow ended plastic plugs are provided and within which are releasably interengaged the crayons.

An engagement portion extending from a further location of the plush body provides a means for securing the body to a fixed location. In a first preferred embodiment, the engagement portion further includes a lanyard loop extending from the plush body, a key ring securing to the lanyard loop. A flexible cord terminates in a clip for securing to the key ring.

In a further application, a flexible accordian cord secures to the key ring and which allows for the body to be stretched or pulled in a given direction. A further application contemplates inter-engaging male and female connectors for securing the body to the fixed location.

BRIEF DESCRIPTION OF THE DRAWINGS

Reference will now be made to the attached drawings, when read in combination with the detailed description, wherein like reference numerals refer to like parts throughout the several views, and in which.

DESCRIPTION OF THE PREFERRED EMBODIMENTS

Figure 1:
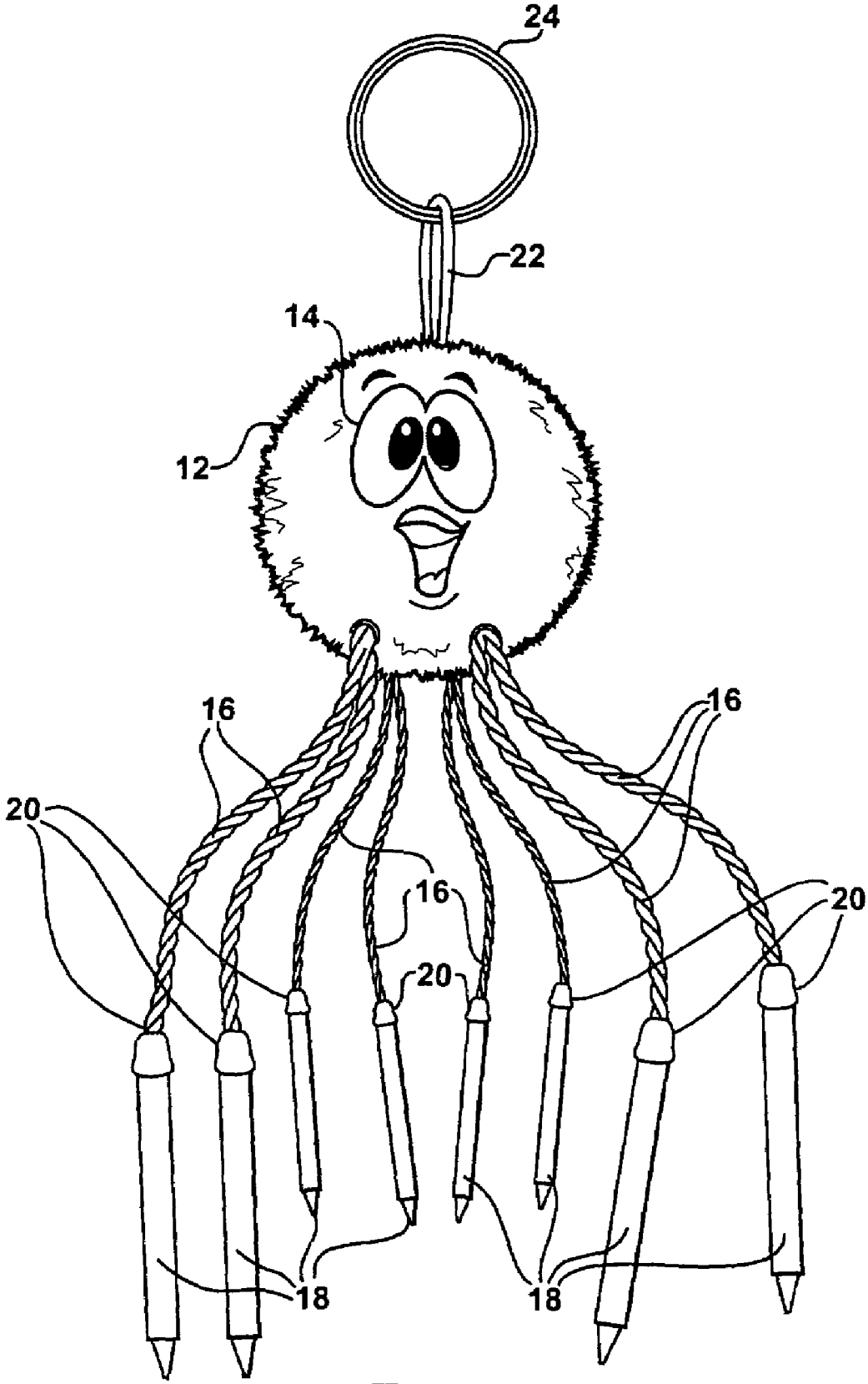
FIG. 1 is an illustration of the traveling crayon holder according to the present invention.

Referring to FIG. 1, a traveling crayon holder is illustrated at 10 according to a preferred embodiment of the present invention. As described previously, the focus of the present invention is on the provision of a crayon holding device capable of being used by children traveling in a vehicle and which prevents crayons from being lost or misplaced in the vehicle seats and under the floorboards.

The device 10 includes in the preferred embodiment a three dimensional plush body, such as a head 12, exhibiting any desired shaping (including round, oval, etc.,) and upon which a desired stitching or indicia 14, in the present instance including eyes, mouth, etc., is applied. In the preferred application, the portable crayon holder head 12 is in the configuration of a toy octopus and which further provides a plurality of (in the preferred illustration eight) elongate extending arms, see at 16, in the form of extending lengths of a decorative line, such as a suitable cord, rope or ribbon-type material.

The lengths of line 16 terminate in a plurality of crayons 18 (or other suitable coloring or writing marker) and which are secured thereto such as by engaging the same to hollow ended plastic plugs 20. Without limitation, it is understood that other types of engagement means (apart from the plugs 20) may be employed for securing the crayons 18 to the individual lines 16 and such that the crayons may be quickly replaced in the instances of them being worn down through use, broken or the like.

Extending from a generally top end location of the plush head 12 is a lanyard loop or the like 22, attached to which in the illustrated version of FIG. 1 is a key ring 24. As will be subsequently described, it is understood that other suitable structure is provided for securing the traveling and portable crayon holder, and such as is best illustrated in the travel configuration 26 of FIG. 2 and whereby the device 10 is secured to a cord or line 28 extending from a location 30 associated with the seatback such that it is capable of being suspended from a rear facing side of a vehicle seat back 32

In a preferred application, it is intended that the portable crayon holding device 10 is accessible to children seated behind the seat back 30 and in such a manner that the crayons 18 are readily accessible. Further, the secured nature of the crayons 18 prevents them from becoming lost or inaccessible, such as which might otherwise occur with them falling between the seat cushions, falling upon the floorboard and rolling under the front seat, and the like.

Figure 2:
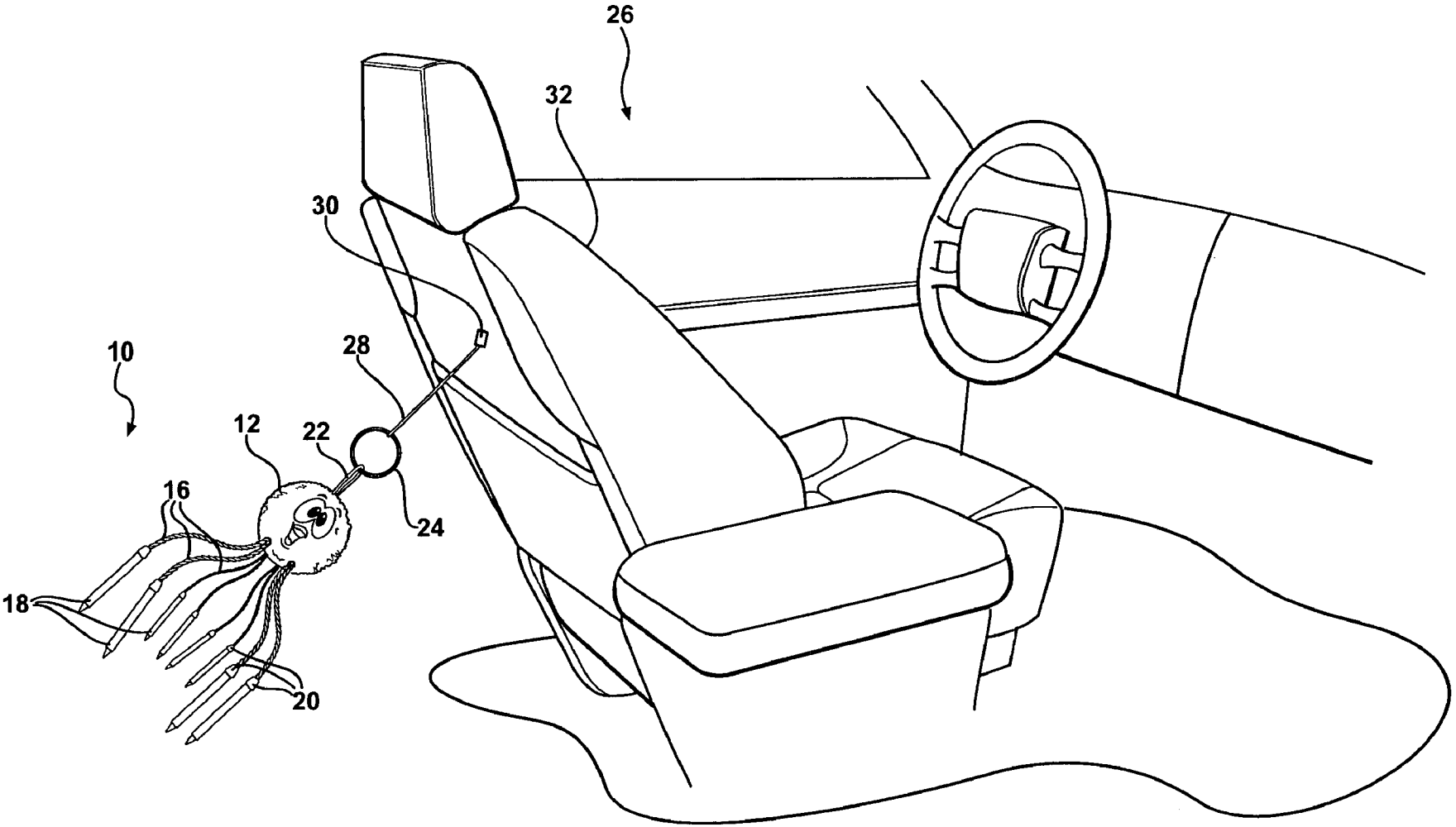
FIG. 2 is an environmental view illustrating the traveling crayon holder mounted such as to a rear facing side of a vehicle seat according to the present invention.
Figure 3:
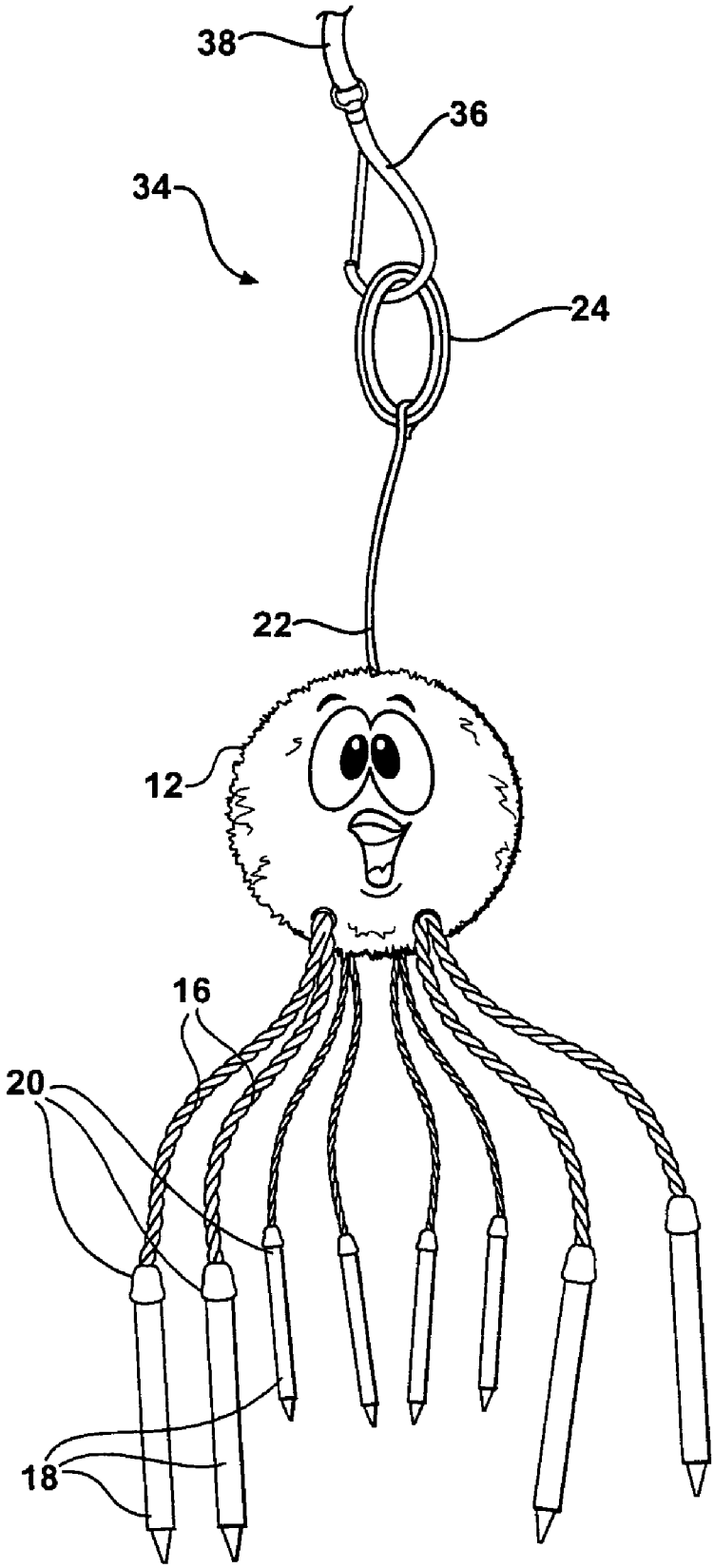
FIG. 3 is a first alternate application of a clip attachment for securing the traveling crayon holder.
Figure 4:
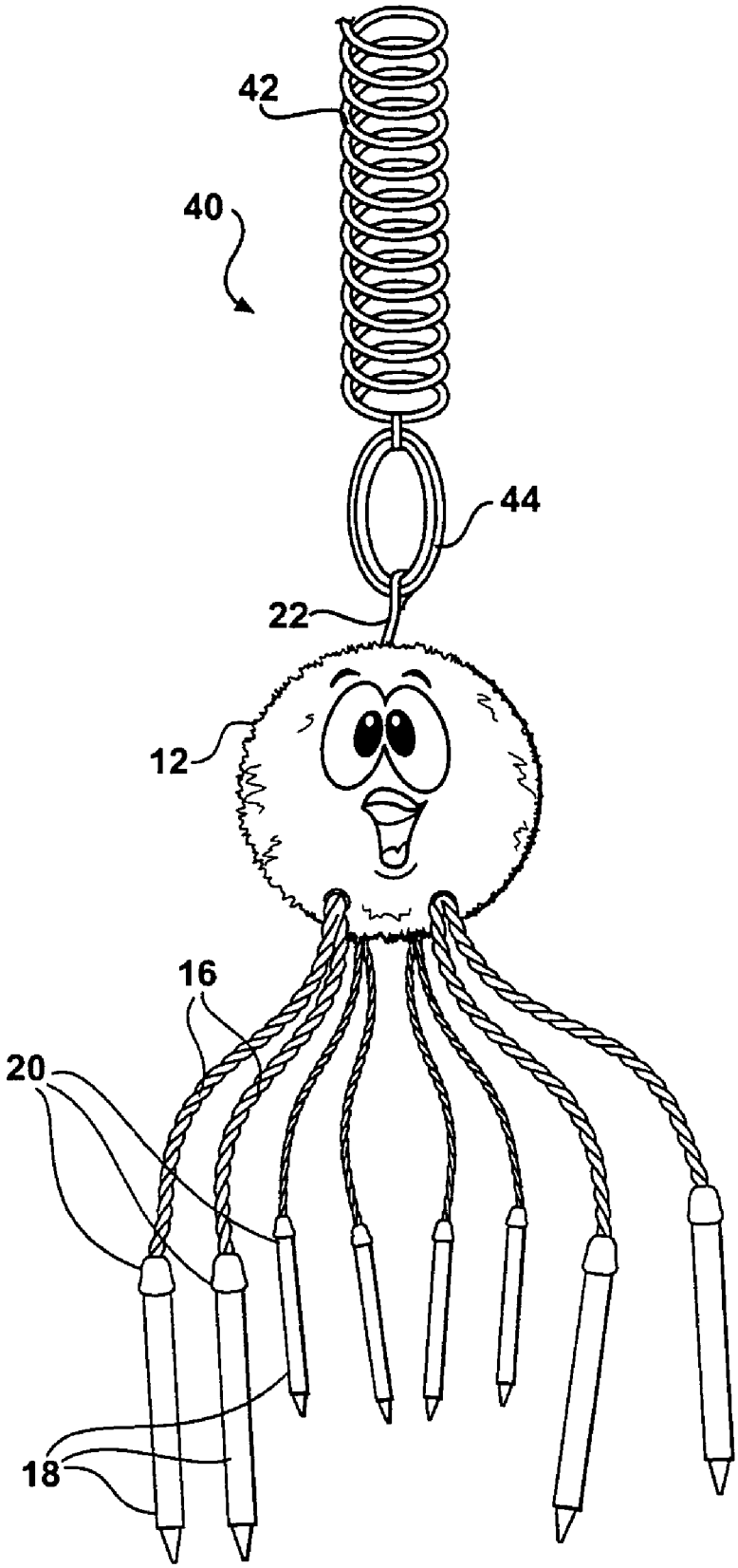
FIG. 4 is a second alternate application of an accordian type band for use with a traveling crayon holder.
Figure 5:
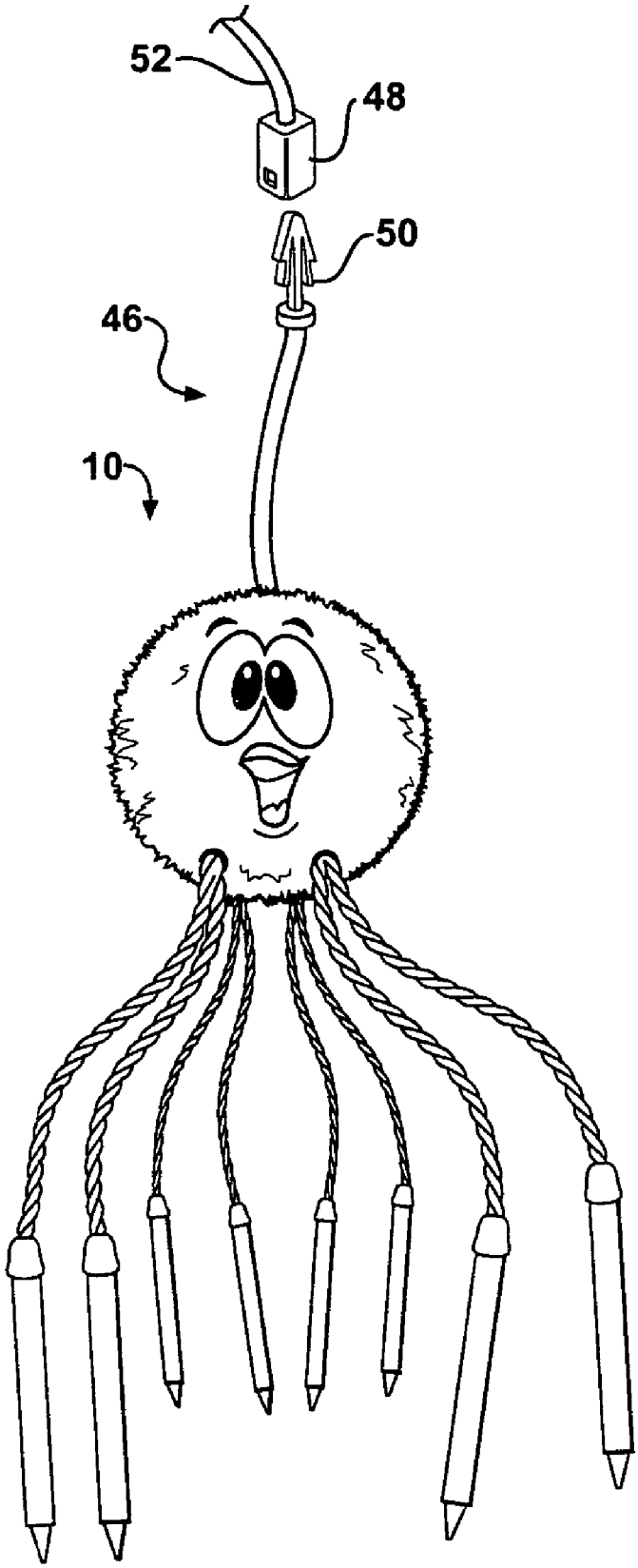
FIG. 5 is a third alternate application of an attachment scheme and which illustrates male to female engagement portions.

Referring to FIGS. 3-5 in succession, some examples of potential mounting applications for the crayon holder device are illustrated. FIG. 3 is a first alternate application 34 of a clip attachment for securing the traveling crayon holder 10 and in particular by which an engaging clip 36 extends from an end of a flexible cord 38. Although not shown, it is envisioned that the cord is attached to a fixed location, such as a seatback as shown in FIG. 2, and such that the crayons are easily accessible.

Referring now to FIG. 4, a second alternate application of an accordian type band for use with a traveling crayon holder is illustrated at 40, and differing in the respect that an accordian type cord or the like 42 can be incorporated for providing a measure of stretch to the device. A ringlet is illustrated at 44 in engagement with the accordian cord 42, however it is understood that the ringlet 44 can provided as a key ring 24 or the like and which is secured directly to the head 12 such as again by lanyard loop 22 such as in a vehicle traveling configuration.

FIG. 5 illustrates at 46 is a third alternate application of male 48 to female 50 engagement portions and which illustrates male to female engagement portions for providing quick connect and disconnect of the crayon holding device 10 to and from such as a fixed location to which a remote end (not shown) of a line 52 extending from connecting portion 48 may be secured. The application of FIG. 5 can also apply in combination with any of the aforementioned embodiments.

Without limitation, the present invention contemplates other and additional attachment schemes for securing the crayon holder to a given location. It is further envisioned that the lengths of line 16 may be adapted, such as by being either lengthened or shortened, to suit any of a number of different applications and within the scope of the invention.

Having described the invention, other and additional preferred embodiments will become apparent to those skilled in the art to which it pertains and without deviating from the scope of the appended claims.

I claim:

1. A traveling crayon holder, comprising:

a three dimensional plush body;

a plurality of arms extending from said body, said arms each further comprising a length of a flexible line material;

a plurality of crayons releasably secured in individual fashion to a like plurality of hollow ended plastic plugs defined at respective ends of each of said lengths of said flexible line material; and an engagement portion extending from a further location of said plush body and providing a means for securing said body to a fixed location.

2. The traveling crayon holder as described in claim 1, said engagement portion further comprising a lanyard loop extending from said plush body, a key ring securing to said lanyard loop.

3. The traveling crayon holder as described in claim 2, further comprising a flexible cord terminating in a clip for securing to said key ring.

4. The traveling crayon holder as described in claim 2, further comprising a flexible accordian cord for securing to said key ring.

5. The traveling crayon holder as described in claim 1, further comprising inter-engaging male and female connectors for securing said body to said fixed location.

6. The traveling crayon holder as described in claim 1, further comprising said body exhibiting a rounded configuration and upon which a desired indicia is applied.

7. The traveling crayon holder as described in claim 1, further comprising a plurality of eight individual lengths of a cord material.

8. A traveling crayon holder, comprising:

a three dimensional plush body;

a plurality of arms extending from said body, said arms each further comprising a length of a flexible line material, each of said lengths of line terminating in a hollow ended plastic plug;

a plurality of crayons releasably secured in individual fashion to respective ends of each of said lengths of flexible line material by engagement within associated plastic plugs; and an engagement portion extending from a further location of said plush body and providing a means for securing said body to a fixed location.

9. The traveling crayon holder as described in claim 8, said engagement portion further comprising a lanyard loop extending from said plush body, a key ring securing to said lanyard loop.

10. The traveling crayon holder as described in claim 9, further comprising a flexible cord terminating in a clip for securing to said key ring.

11. The traveling crayon holder as described in claim 8, further comprising a flexible accordian cord for securing to said key ring.

12. The traveling crayon holder as described in claim 8, further comprising inter-engaging male and female connectors for securing said body to said fixed location.

13. A traveling crayon holder, comprising:

a three dimensional plush body;

a plurality of arms extending from said body, said arms each further comprising a length of a flexible line material, each of said lengths of line terminating in a hollow ended plastic plug;

a plurality of crayons secured in individual fashion to respective ends of each of said lengths of flexible line material by engagement within associated plastic plugs; and an engagement portion extending from a further location of said plush body and providing a means for securing said body to a fixed location, said engagement portion further comprising a lanyard loop extending from said plush body, a key ring securing to said lanyard loop.

* * * * *